US008839841B2

(12) United States Patent
Koop et al.

(10) Patent No.: US 8,839,841 B2
(45) **Date of Patent: *Sep. 23, 2014**

(54) ROLLER BLIND MOUNTING SYSTEM AND PARTS THEREFOR

(75) Inventors: Lars Koop, Bremerhaven (DE); Jörg Bohlen, Langen (DE)

(73) Assignee: Hunter Douglas Industries BV, Rotterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/443,095

(22) Filed: Apr. 10, 2012

(65) Prior Publication Data

US 2012/0193042 A1 Aug. 2, 2012

Related U.S. Application Data

(60) Continuation of application No. 12/775,925, filed on May 7, 2010, now Pat. No. 8,151,859, which is a division of application No. 11/950,763, filed on Dec. 5, 2007, now Pat. No. 7,740,047.

(30) Foreign Application Priority Data

Dec. 14, 2006 (EP) ..... 06025885

(51) Int. Cl.
*A47H 1/13* (2006.01)

(52) U.S. Cl.
USPC ..... 160/325; 160/323.1; 160/321

(58) Field of Classification Search
USPC ..... 160/323.1, 324, 325, 326; 248/267, 248/269; 211/105.6, 105; 410/149
See application file for complete search history.

(56) References Cited

U.S. PATENT DOCUMENTS

| | | | |
|---|---|---|---|
| 1,049,485 | A | 1/1913 | Hoyt |
| 1,057,603 | A | 4/1913 | Whitney |
| 1,090,931 | A | 3/1914 | McLean |
| 2,013,500 | A | 9/1935 | O'Connor |

(Continued)

FOREIGN PATENT DOCUMENTS

| | | | |
|---|---|---|---|
| DE | 1 654 093 | A1 | 2/1971 |
| DE | 27 21 629 | A1 | 11/1978 |

(Continued)

OTHER PUBLICATIONS

European Search Report dated Jun. 2, 2008 of corresponding European patent application No. 07 25 4737 (1 page).

*Primary Examiner* — Blair M. Johnson
(74) *Attorney, Agent, or Firm* — Dorsey & Whitney LLP

(57) ABSTRACT

A mounting system for an architectural covering including a pair of mounting brackets, a roller operably connected to each of the mounting brackets, and an end plug at least partially received within the roller and operably connected to one of the mounting brackets. The end plug selectively transitions between an extended position and a retracted position and includes a sleeve, a plunger received within the sleeve, and a spring at least partially received within the plunger for biasing the plunger away from the sleeve. The plunger includes a center or body section and at least two radially spaced tongues extending from a first end of the center section. In the extended position a first portion of the plunger projects from the sleeve and in the retracted position at least a portion of the first portion of the plunger is received within the sleeve.

20 Claims, 11 Drawing Sheets

(56) References Cited

U.S. PATENT DOCUMENTS

| | | | | |
|---|---|---|---|---|
| 2,106,073 | A | 1/1938 | Stuber | |
| 2,999,664 | A | 9/1961 | McCullouch | |
| 3,961,822 | A | 6/1976 | Daniel | |
| 4,168,094 | A * | 9/1979 | Yagi | 296/37.16 |
| 4,628,635 | A * | 12/1986 | Maillard | 49/55 |
| 5,934,354 | A * | 8/1999 | Price et al. | 160/370.22 |
| 6,196,508 | B1 | 3/2001 | Nijs | |
| 6,347,483 | B1 * | 2/2002 | Andersen | 49/57 |
| 7,051,782 | B2 | 5/2006 | Nichols, Jr. et al. | |
| 7,422,048 | B2 | 9/2008 | Andersen | |
| 2002/0189771 | A1 * | 12/2002 | Colson et al. | 160/323.1 |
| 2005/0183835 | A1 | 8/2005 | Nien | |

FOREIGN PATENT DOCUMENTS

| | | | |
|---|---|---|---|
| DE | 103 51 336 | A1 | 5/2004 |
| DE | 20 2004 015 105 | U1 | 5/2005 |
| EP | 0 784 145 | A1 | 7/1997 |
| GB | 2 310 878 | A | 9/1997 |
| GB | 2 313 143 | A | 11/1997 |
| GB | 2 339 820 | A | 2/2000 |

* cited by examiner

ROLLER BLIND MOUNTING SYSTEM AND PARTS THEREFOR

CROSS REFERENCE TO RELATED APPLICATION

This application is a continuation application of U.S. patent application Ser. No. 12/775,925 filed May 7, 2010, now U.S. Pat. No. 8,151,859, which is a divisional application of U.S. application Ser. No. 11/950,763 filed Dec. 5, 2007, now U.S. Pat. No. 7,740,047, which application claims priority to European Application No. 06025885.2, filed Dec. 14, 2006, which are hereby incorporated in their entireties by reference as though fully disclosed herein.

BACKGROUND OF THE INVENTION

1. Field of the Invention

This invention relates to a system for mounting for a roller of an architectural opening and parts of the system.

2. Description of the Relevant Art

Various blinds are known for selectively covering architectural openings. Many of these include rollers that are rotatably mounted, usually in a horizontal orientation, for instance across the top of an architectural opening. To facilitate installation of the roller, an arrangement may be provided whereby a pair of brackets is mounted on opposite ends of a top frame of an architectural opening. The roller is than fitted between the two brackets. Several ways of fitting a roller between brackets are possible. The ends of the roller may be provided with co-axially extending end plugs with axial holes for receiving a tab-like projection from the brackets Or the ends of the roller may be provided with co-axially extending end plugs and the end plugs being provided with axially projecting tabs or noses for insertion into an opening in a bracket. Or, in the case where roller blinds are mounted side by side, the central shaft of the roller blinds may be coupled together end the end plugs may be provided with such shaft coupling means to be mounted to an intermediate bracket.

For a roller to be secured in place between two brackets, the distance between the ends of the roller must be greater than that between the brackets. Providing a roller with at least one telescopically movable end plug, solves this problem. Retracted or depressed, such an end plug reduces the effective length of the roller and the distance between the two ends of the roller, extended the end plug restores the roller to its original length. Additional locking means preventing inadvertent retraction or depression of the telescopically movable end plug and thus inadvertent disengagement of the roller from the brackets are often also provided and are described in GB 2 310 878 A and in GB 2 313 143 A.

In this respect GB 2 310 878 A describes an end plug (20) for a roller blind including a telescopic movable drum (6) biased to an extended position by spring (30). The locking means comprises a spring C-clip (40), positionable about the projecting portion (7) of the telescopic movable drum (6) between the roller end (23) and the end (8) of the drum (6), and prevents the telescopic member (6) from moving axially into end plug (20). This solution has as drawback that the C-clip (40) needs to be dimensioned in relation to the blind for which it is used. If it is to long, exceeding the length of the projecting portion of the telescopic member of the end plug, it will not fit.

GB 2 313 143 A describes a locking ring (100) for placement about a telescopic movable spigot (54), which is biased to an extended position by a spring. The locking ring (100) is placed about the spigot (54), is pushed until it makes contact with the roller end (10) remote from the bracket (80), and is locked in place with a grub screw. The ring has a radial through hole (102) with the grub screw (104), which when tightened locks the ring (100) in place. The ring (100) prevents depression of the spigot (54) and thus prevents accidental removal of the blind from its brackets. This solution has as drawback that while positioning of the ring, attention has to be paid to the reachability of the grub screw (104) as well. Accordingly an object of the invention is to provide a roller mount system with a end plug module which overcomes or ameliorates the disadvantages of the end plugs of both GB 2 310 878 A and GB 2 313 143 A.

Another problem associated with mounting a roller to a surface is to get it mounted levelly. If a roller is mounted to un-levelly placed brackets or to brackets mounted onto a lopsided surface, this will lead to an unsightly situation. Although the fact that a roller is not level is often not immediately apparent to the naked eye, it will be once the blind material is unrolled. Subsequently, when the blind material is wound about the unlevel roller it will skew and may get damaged by being improperly supported by roller. The sides of the blind material may ride against the sides of the architectural opening, get in the way of the operating mechanism or even squeeze between the bracket and the roller. In case the blind includes side guides, which is often the case for insect screens and black-out roller blinds, the screen or blind material edges will not keep to the side guides. As a result insects and/or light will enter the building.

Generally the blind is leveled by using the oblong mounting holes in the brackets of the blind. After-adjustment of the bracket's position, requires nimble hands and/or dismounting of the roller from the brackets to facilitate reaching and manipulating it. It generally is a cumbersome process. Another solution is to use brackets with integrated leveler means that act directly or indirectly on the roller of the blind. Such brackets are described in U.S. Pat. No. 6,196,508 and DE 103 51 336 A1.

In this respect U.S. Pat. No. 6,196,508 describes a roller blind bracket with a centrally located cut out portion (11) with slidably located a vertically adjustable glide (4) which rests on a threaded leveling screw (5). The threaded leveling screw (5) can be accessed from the bottom of the bracket. Alternatively, for a motorized shade, the glide (4) is omitted and the leveling screw (5) acts directly on the steel rod of the motor. By adjusting the leveling screw (5) the entire roller shade (13) can be adjusted.

DE 103 510 336 A1 describes a insect screen roller blind with a leveler (22) in a roller bearing (14) which includes a cut out portion (28) and a leveling screw (34) acting on the roller spigot (30). These levelers are integrated with the brackets.

Alternatively U.S. Pat. No. 7,051,782 describes a leveler which is not integral with the bracket but is assembled thereto starting from two separate plate-like members 158, 160. Fasteners 46 are used to attach plates to the bracket, on of the plates being fixed and the other operable to move relative to the fixed plate. This is essential for any leveler, each leveler necessarily includes a base to be anchored to a fixed surface such as a bracket and an operator connected to that base, movable between two positions, and acting either directly or indirectly on a roller end in order to move the roller between these two positions.

The use of the known prior art levelers requires either a preordained choice of using a bracket with integral leveler, or leads to a very cumbersome after-installment of the leveler once it is needed after all.

Thus another object of the invention is to provide a leveler module for the roller mount system which does not have these drawbacks and is easy to manipulate.

Another problem associated with mounting a roller to a surface are the brackets. When a roller blind is mounted to a roof window or sunroom window that is slanted, the bracket will cause the blind to be at an angle to the window unless a specially shaped bracket is used which cancels out the window frame angle. Such a bracket is described in EP 0 784 145 A1, this bracket includes adjusting means that can cancel out the angles of the window relative to that of the blind. Also it is often necessary to choose different modules for a roller system often require different brackets, e.g., an intermediate bracket in a compound roller system having at least two rollers mounted next to each other, is often of different configuration from the outer bracket.

BRIEF SUMMARY OF THE INVENTION

According to one aspect of the invention roller blind mounting system is provided comprising at least one roller, at least one telescopic end plug engageable within an end-opening of one of said rollers, the end plug including a hollow body and a telescopically movable member or plunger co-axially positionable with respect to the hollow body such that a first axial extending length portion of the plunger projects from the hollow body and a second axial extending length portion is held within the hollow body and the plunger being telescopically movable between a first end position in which the first portion of the plunger projects from the cylindrical body and a second end position in which at least part of the first portion is inserted into the cylindrical body, and at least two brackets which include a central aperture and the first axial length portion is mountable to the central aperture of the bracket.

Advantageously the telescopic end plug further has a rotatable end cap rotatably fixed to the end of the second length portion and the end cap is adapted be received in the central aperture of the bracket such that the telescopic end plug and the roller engageable therewith are rotatably mountable to said bracket.

According to another aspect of the invention the bracket further includes at least a pair of openings positioned about said central aperture and the opening of each pair being in line with each other, and the mounting system further includes an operating module or a leveler module, or both, provided with mounting means adapted to co-operate with the at least one pair of slots of the bracket.

Advantageously, the mounting means are hook-like members adapted to project through the openings of the bracket and grip the rim of the openings. Also, the hooks each include a stem portion and a grip portion extending from the top of the stem portion.

Advantageously, the grip portion of the hook extends sideways from the top of the stem portion.

Alternatively, the grip portion of the hook extends downwardly from the stem portion.

According to another aspect of the invention, a combination of a bracket and a module is provided of which the module is adapted to co-operate with the bracket, and the bracket includes a flange with at least a pair of openings positioned spaced apart and opposite each other on said flange about said central aperture, and the module includes at least one pair of mounting means adapted to co-operate with the at least one pair of slots of the bracket.

According to yet another aspect of the invention, a telescopic end plug is provided which is engageable within an end-opening of a roller and includes a hollow body and a telescopically movable member or plunger co-axially positionable with respect to the hollow body such that a first axial extending length portion of the plunger projects from the hollow body and a second axial extending length portion is held within the hollow body and the plunger being telescopically movable between a first end position in which the first portion of the plunger projects from the cylindrical body and a second end position in which at least part of the first portion is inserted into the cylindrical body, and the end plug further includes a locking member positionable on said first axial length portion for locking the plunger against movement towards the second end portion, and the first axial extending length portion of the plunger is threaded and the locking member is rotatably receivable on the thread such that it is positionable on the first length portion for locking the plunger against axial movement towards its second end position beyond the locking member.

According to yet another aspect of the invention a leveler module is provided which includes a base member and a roller carrier slidably connected to said base member, an operator between the base and the roller carrier and connected thereto such that manipulation of the operator causes the roller carrier to slide relative to the base member and the leveler module further includes mounting means adapted to removably mount the module to a bracket.

The invention thus solves the problems associated with mounting of roller blinds.

BRIEF DESCRIPTION OF THE DRAWINGS

The invention will be further described in reference to the accompanying drawings, in which.

DESCRIPTION OF THE PREFERRED EMBODIMENTS

Telescopic End Plug

Figure 1:
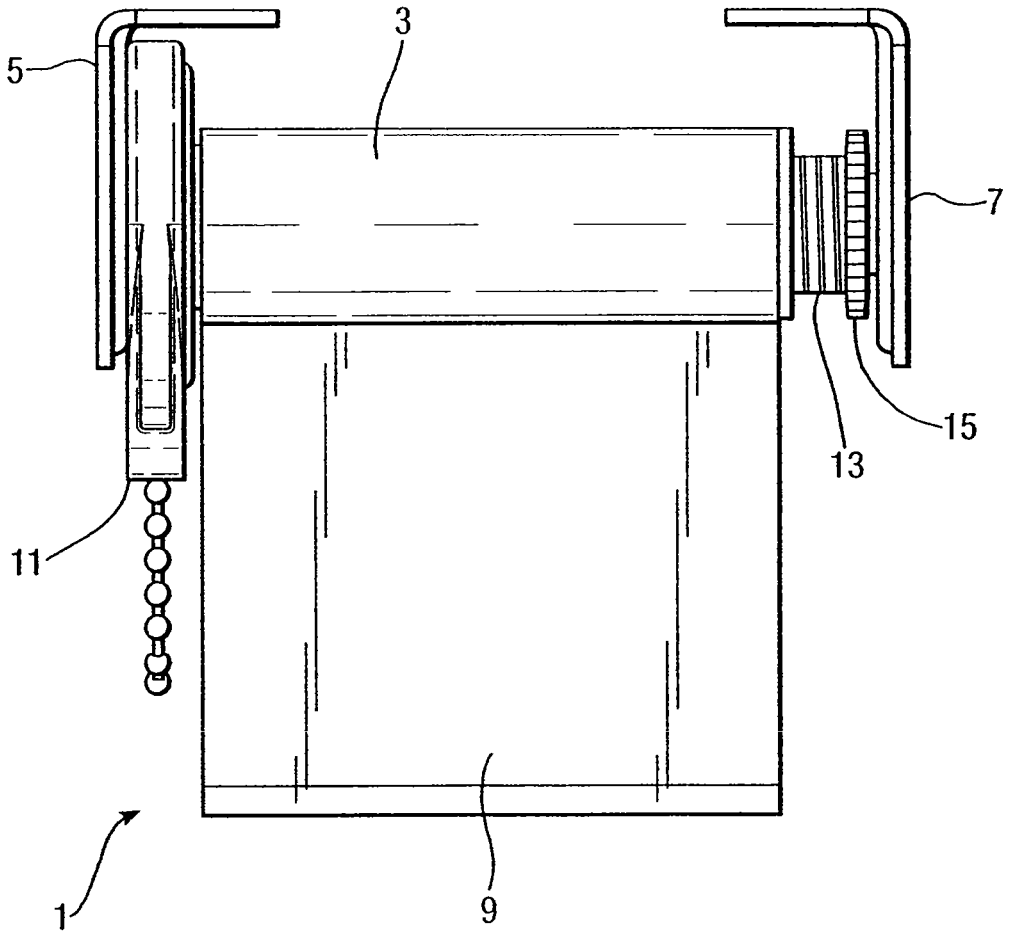
FIG. 1 is a schematic, perspective view of a roller blind mounted between two brackets and equipped with the roller mounting system of the invention including a telescopic end plug with the locking means in unlocked position allowing depression of the end plug into the roller.

In FIG. 1 a roller blind 1 is shown with roller 3 mounted between a left and right mounting bracket 5, 7. The blind material 9 is schematically indicated and can be wound and unwound from the roller by operating the bead chain operating mechanism 11. A telescopic end plug 13 in the right end 3A of the roller 3 facilitates mounting of the roller. Depressing the end plug 13 reduces the effective length of the roller 3 making it easy to position between the two brackets 5, 7. Retracting the end plug 13 to its extended position restores the roller 3 to its previous length, allowing the roller to connect to the left and right brackets by suitable end plugs on either side. A locking ring 15 prevents the inadvertent depression of the telescopic end plug 13. In FIG. 1 the ring 15 is shown in the un-locked position, adjacent the outer end of the telescopic end plug. By positioning the ring adjacent the roller end 3A, depression of the telescopic end plug is prevented.

Figure 2:
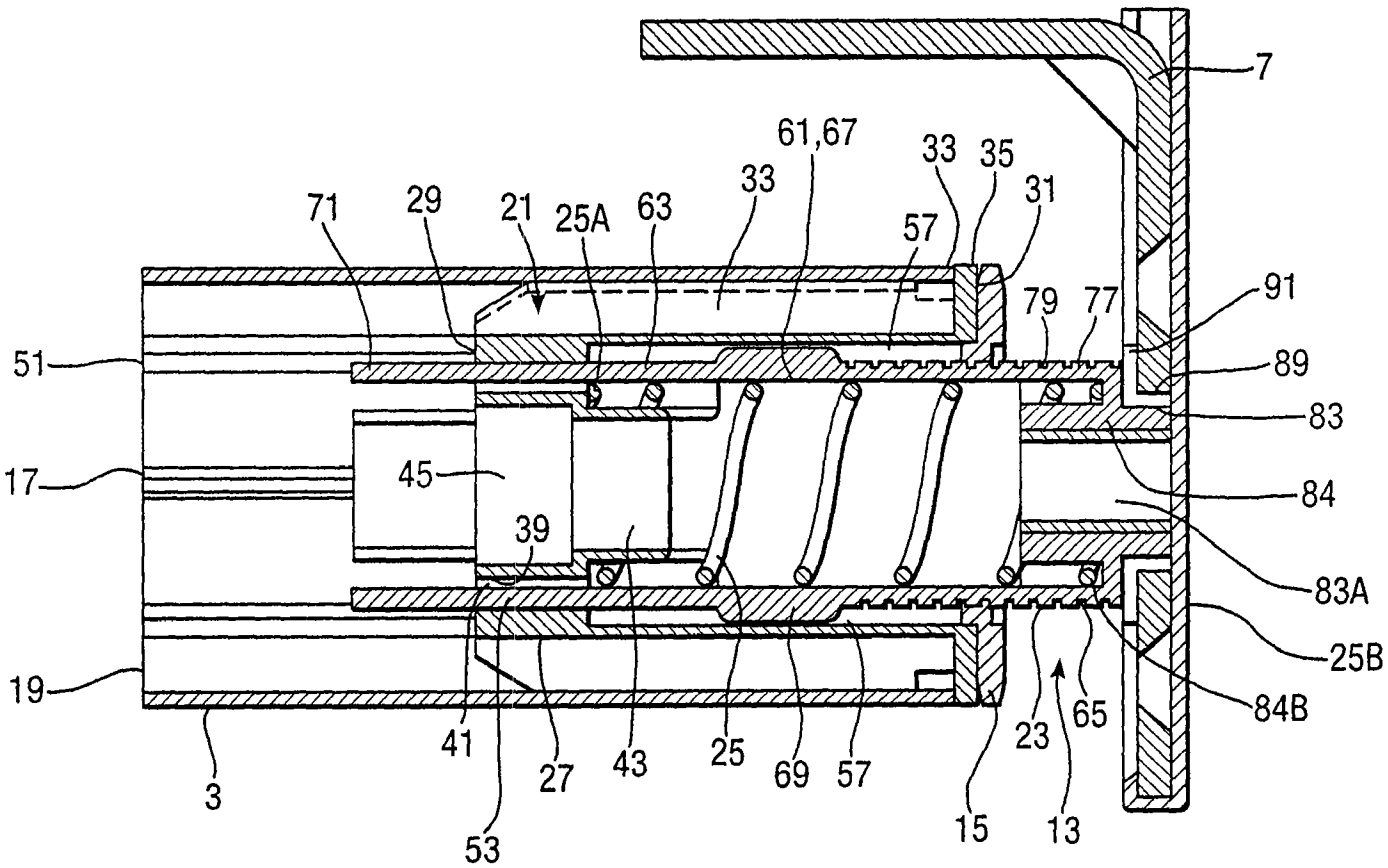
FIG. 2 is a cross-sectional view of a first embodiment of the roller mounting system of the invention with the telescopic and plug mounted to a bracket and with the locking means in locked position preventing insertion of the end plug into the roller.
Figure 3:
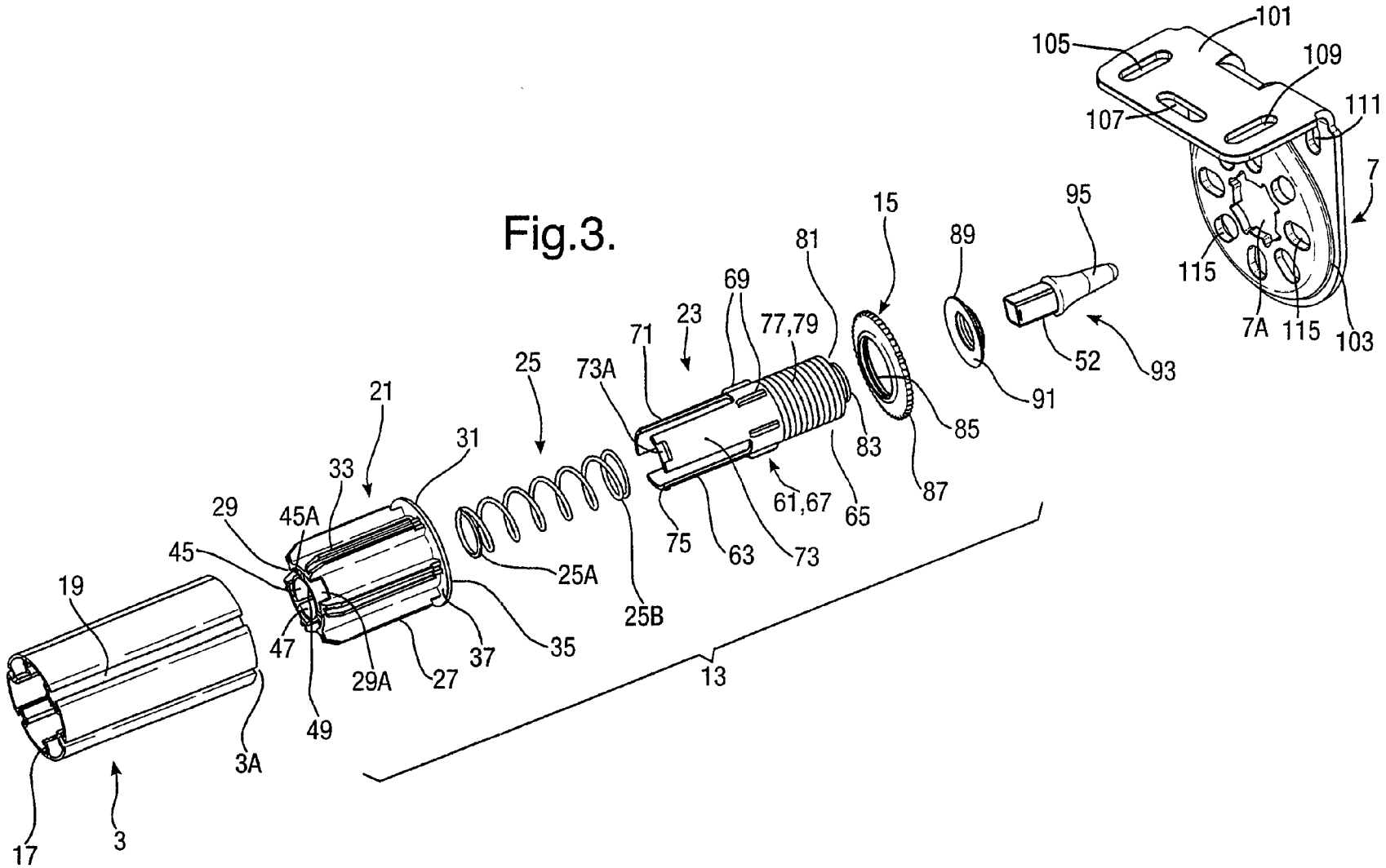
FIG. 3 is an exploded view of the embodiment of FIG. 2.

In FIG. 2 the roller 3 and telescopic end plug assembly 13 are shown in cross-section as mounted to the right bracket 7, FIG. 3 shows these parts in exploded view.

In FIGS. 2 and 3 only a part of the roller 3 is shown. It is a conventional roller for a roller blind. As such the roller 3 is a tube like member of general cylindrical cross-section, typically made of aluminum, steel or plastic. Axially and inwardly projecting strengthening ribs 17, and at least one groove 19 extend along is axial length the roller. The ribs 17 provide an internal configuration of the roller to hold the end plug and the groove is for attachment of the blind fabric.

The end plug assembly 13 includes a hollow cylindrical body or sleeve 21, a telescopically movable member or plunger 23, a spring 25 and a ring 17.

The sleeve 21 is of general cylindrical cross-section and has a tube like portion 27 which extends between an inner or left axial end 29 and an outer or right axial end 31. The tube 27 includes axially extending and radially outwardly projecting ribs 33 so that the body can be fitted within the roller 3, the sleeve ribs engaging the roller ribs. The outer axial end 31 has a radial collar 35 with a radial inner surface 37 that abuts the axial outer end 3A of the roller 3 when the cylindrical body is inserted in the roller.

Inside the hollow cylindrical body 21 and adjacent the inner or left axial end 29 is a retainer 39 fixed co-axial to the body 21 for support of both the plunger 23 and the spring 25. The retainer 39 includes a circular (radial) base or abutment surface 41 facing the right axial end 31 of the tube 27, the radius of the abutment surface is smaller than the radius of the tube 27. Projecting axially from the base 41 and toward the right axial end 31 is a retainer tube 43 which is co-axial with the cylindrical body tube 27 and of smaller radius than the base 41. Projecting axially from the base 41 and toward the left axial end 29 are at least two and preferably three radially spaced apart axially extending flanges 45, 47, 49. Each flange 45, 47, 49 is spaced from the inner surface of the tube 27 while following the radius thereof. Each flange 45, 47, 49 has a left and right radial extending ribs 45A, 45B, 47A, 47B and 49A, 49B connecting the flanges to the inner surface of the tube 27, and thus defining axial passage ways 51, 53, 55 between the co-axial flanges 45, 47, 49 and the inner surface of the tube 27.

The inner surface of the tube 27 is provided with a plurality of axially extending radially spaced apart grooves 57. The grooves 57 extend axially from at least the right or outer axial end 31 to the base 41 of the retainer 39.

The telescopically movable member or plunger 23 from the end plug assembly 13 is suitable for insertion into the hollow cylindrical body 21 from the outer or right axial end 31 thereof towards the inner or left end 29.

The plunger 23 is of general cylindrical cross-section of a smaller radius than the cylindrical body 21. The plunger 23 includes a centre or base section 61, a left or inner portion 63 and a right or outer portion 65, each extending to opposite sides from the central section 61.

The center or base section 61 is a tube like portion 67 with a plurality of axially extending ribs 69 radially spaced on the outer surface of the base 63. The ribs 69 are designed to slidingly co-operate with the grooves 57 of the inner surface of the tube 27 of the cylindrical body 21.

The left or inner part 63 projects axially from the base 61 and comprises at least two and preferably three radially spaced apart tongues 71, 73, 75. The tongues 71, 73, 75 can be slidably retained in the axial passage ways 51, 53, 55 defined between the retainer 39 and the body 21. Movement of the plunger in axial direction is possible because the tongues move within the axial passage ways 51, 53, 55. The plunger tongues 71, 73, 75 can extend beyond the left end 29 of the body 21 when plunger is deeply inserted into the body. However the centre section 61 of the plunger 23 will hit the base 41 of the retainer when the plunger 23 is inserted to its maximum depth into the body.

In order to prevent inadvertent disengagement of the plunger 23 from the cylindrical body 21, the tongues 71, 73, 75 each include a lug 71A, 73A, 75A at the axial end away from the base 61 on the outer surface of the tongues which cooperates with an indented portion 29A of the inner axial end 29 of the cylindrical body 21. Inserted into the cylindrical body 21, the lugs 71A, 73A, 75A snap behind the indented portion 29A and thus prevent disengagement of the plunger from the body.

The right or outer part 65 of the plunger 23 projects axially from the base 61 opposite from the inner part 63. The outer part 65 is provided with a circumferential screw thread 77 with a plurality of windings 79. The axial end 81 of the outer part 65 is provided with an axial extending spigot 83 which in turn has an axial through opening 83A suitable for receiving a shaft. The opening 83*a* necessarily has the same cross-section as the shaft for which it is intended. Shafts in roller blinds, are generally used for operatively connecting two blinds side by side, such that these blinds need only a single operating system, either manually or motor driven. The opening's 83*a* inner diameter is smaller than that of the spigot 83, while the spigot's 83 outer diameter is smaller than that of the plunger 23.

The circumferential screw thread 77 receives the locking ring 15 which is provided with an inner thread 85 suitable for running on the circumferential thread 77. Preferably the threads are chosen such as to be a self-braking thread in order to prevent the ring 15 from traveling along the circumferential thread due to vibrations caused by installation or use of the roller.

The ring or disc-like locking nut 15 has circumferential outer surface that is provided with serrations or teeth 87 for easy manipulation thereof. Alternatively the ring 15 can be shaped as a hexagonally nut.

A rotatable mounting cap 89 fits rotatably on spigot 83, and the total diameter of cap and spigot is designed to fit into a central mounting opening 7A of the bracket 7. The cap 89 includes a radially projecting collar 91, the outer surface of which abuts the bracket 7 surface when the roller is mounted thereto, so that the roller can rotate relative to the bracket and the cap 89. The radially projecting collar 91 further prevents the ring 15 from inadvertently running off the plunger 23, especially when the roller is not yet mounted to a bracket. The cap 89 is hollow and surrounds the spigot thus the keeps free the spigot opening 83A suitable for receiving a shaft.

Compression spring 25 has a left first winding 25A and a right first winding 25B and a plurality of windings therebetween. The spring 25 is preferably made from steel and can be used in the end plug to bias the plunger 23 in the direction of the outer axial end 31 of the body 21. For this purpose the spigot 83 projects axially into the outer portion 65 such that a co-axial spigot body 84 is formed within the plunger 23. The spigot body 84 includes a circular (radial) base 84B between the spigot-body 84 and the inner surface of the plunger 23. The spring, when used, will rest with one end winding 25A on the retainer base 41 of the sleeve and with the other end winding 25B on the spigot body base 84B of the plunger. The spring 25 will have a greater length than the distance between these two bases 41, 84B and thus bias the plunger to its extended position.

If so desired an additional installation tool 93 can be used for ease of mounting the roller to the bracket. The tool 93 as shown in the FIG. 3 is a so-called locator-nose and includes a nose-cone 95 and a butt-shaft 97. The butt-shaft 97 is inserted into the opening in the spigot and the nose cone 95 gives a greater ease of installation. Specifically the nose cone 95 assists an installer in locating the central aperture 7*a* of a bracket 7, without needing a clear line of view. Once the roller is installed, the tool 93 can be removed from the side opposite the bracket by pulling the nose cone 95, since the spigot mates with the central opening of the bracket and the tool projects from the spigot.

The brackets 5 and 7 are of similar shape and both have a generally horizontally extending first flange 101 and a depending vertically extending second flange 103. The first flange 101 has slots 105, 107 and 109 for receiving fasteners (not shown, but conventional) to mount the first flange against either under a horizontal building surface or to a vertical building surface adjacent a window opening. The second flange 103 has similar slots 111 and 113 for alternative mounting to a vertical building surface in the proximity of a window opening.

The second flange 103 of the bracket has a pattern of radially arranged slots or oblong holes 115 arranged around the central aperture 7A. For left bracket 5 these oblong holes are used for receiving a pair of opposite mounting hooks of the operator module 11 (as is explained in relation to FIGS. 10-13). The spacing of each pair of radially aligned oblong holes 115 corresponds to the spacing between such mounting hook members on the operator module 11. As is explained later, in relation to FIG. 5, the radially aligned oblong holes 115 can also be used to mount other modular parts, such as a leveler module 200. The arrangement of the four pairs of radially aligned openings 115 allows for a selection of angular positions into which the modules can be mounted in respect of the bracket's flange.

In order to mount or dismount the roller from the brackets 6,7, the locking ring 15 needs to be in the unlocked position. The unlocked position is any position of the ring 15 on the thread 77 of the outer part 65 of the plunger 23 away from the locked position, thus away from the right roller end 3A, and allows depression of the plunger 23 to a sufficient extend reducing the effective length of the roller 3 to mount or dismount of the roller between the brackets 6,7. Preferably in the unlocked position the locking ring 15 is adjacent the axial end 81 of the outer part 65 of the plunger 23, as shown in FIG. 1. Once the roller 3 is in place between the brackets, a spring assisted end plug 13 can be released to extend to its original position and locked in place by rotation of the locking ring 15 to the locking position. Or when the end plug 13 is without compression spring 25, the plunger 23 needs to be manipulated to the extended position and locked in place by rotation of the locking ring 15 to the locking position. The locked position is when ring 15 is adjacent the right roller end 3A. In this position the locking ring 15 prevents depression of the plunger 23 of the end plug 13. This position is shown in FIG. 2. This position, chosen when the roller 3 is mounted to the brackets 6, 7, prevents inadvertent dismounting of the roller.

Since the ring 15 is on the thread 77 it is very easy to manipulate, even single handed.

Leveler

Figure 4:
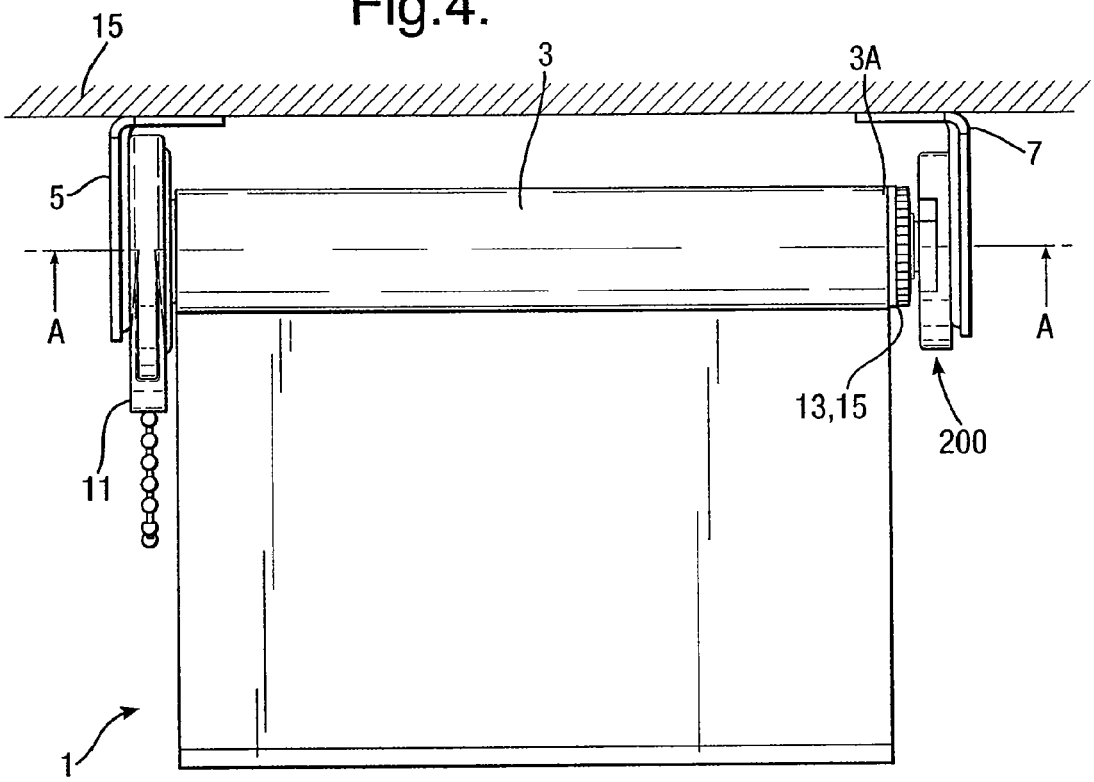
FIG. 4 is schematic perspective view of the roller blind of FIG. 1 to which a leveler module is added.

FIG. 4 shows the roller blind 1 of the first embodiment to which a leveler module 200 is added. In describing this embodiment of the invention which is similar to that of FIG. 1 corresponding reference numerals are used below for the same parts or corresponding parts.

The roller blind 1 of FIG. 4 is shown with roller 3 mounted between a left and right mounting bracket 5, 7. The blind material 9 is schematically indicated and can be wound and unwound from the roller by operating the bead chain operating mechanism 11. The telescopic end plug 13 in the right end 3A of the roller 3 is visible by its locking ring 15. As can be seen the locking ring 15 is adjacent the right roller end 3A and thus the plunger (not visible) of the end plug 13 is in its locked position.

The brackets 5 and 7 are mounted to a ceiling surface (S) and the roller 3 is mounted to between them. As can be seen by comparing the roller axis (A) with this surface (S), it is lopsided. Thus a leveler is needed. Adjacent the right bracket 7 is placed the leveler module 200 of the invention. By operating the leveler module, a range of positions of the right roller end 3A between a lower position and an upper position can be chosen.

Figure 5:
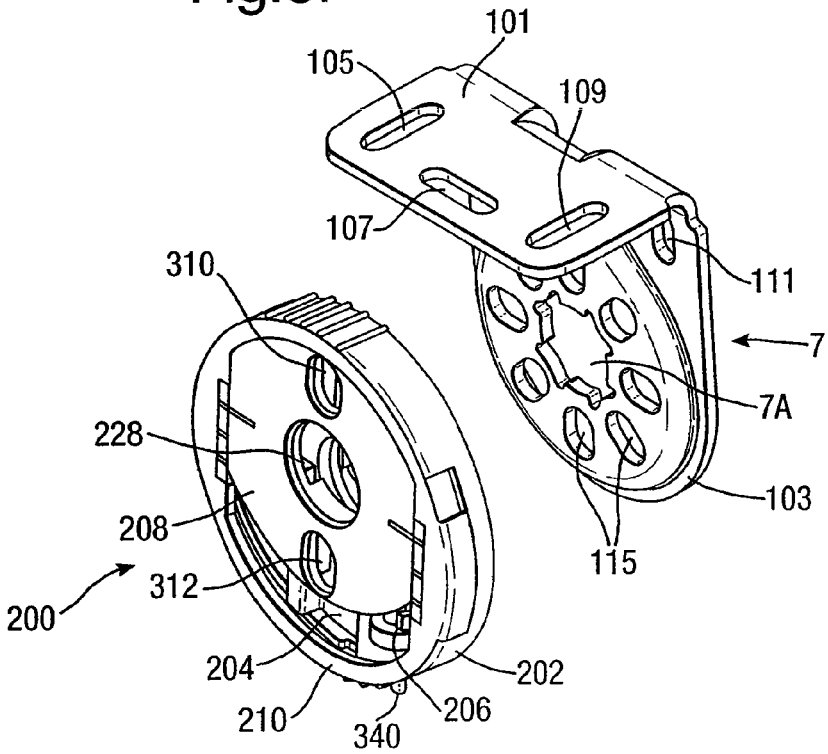
FIG. 5 is schematic perspective view of the leveler module of FIG. 4 adjacent a mounting bracket to which it can be attached

FIG. 5 shows the leveler module 200 separate from the bracket 7. One of the advantages of the leveler module 200 of the invention over the prior art levelers is that it can be easily mounted to the bracket 7 as complete module. This is explained further on in the description. The leveler module 200 includes a rotatable mounting tray 202, a base member 204, a roller carrier 206 slidably connected to the base member 204, with an operator 208 between the base 204 and the roller carrier 206, and an cover ring 210.

Figure 6:
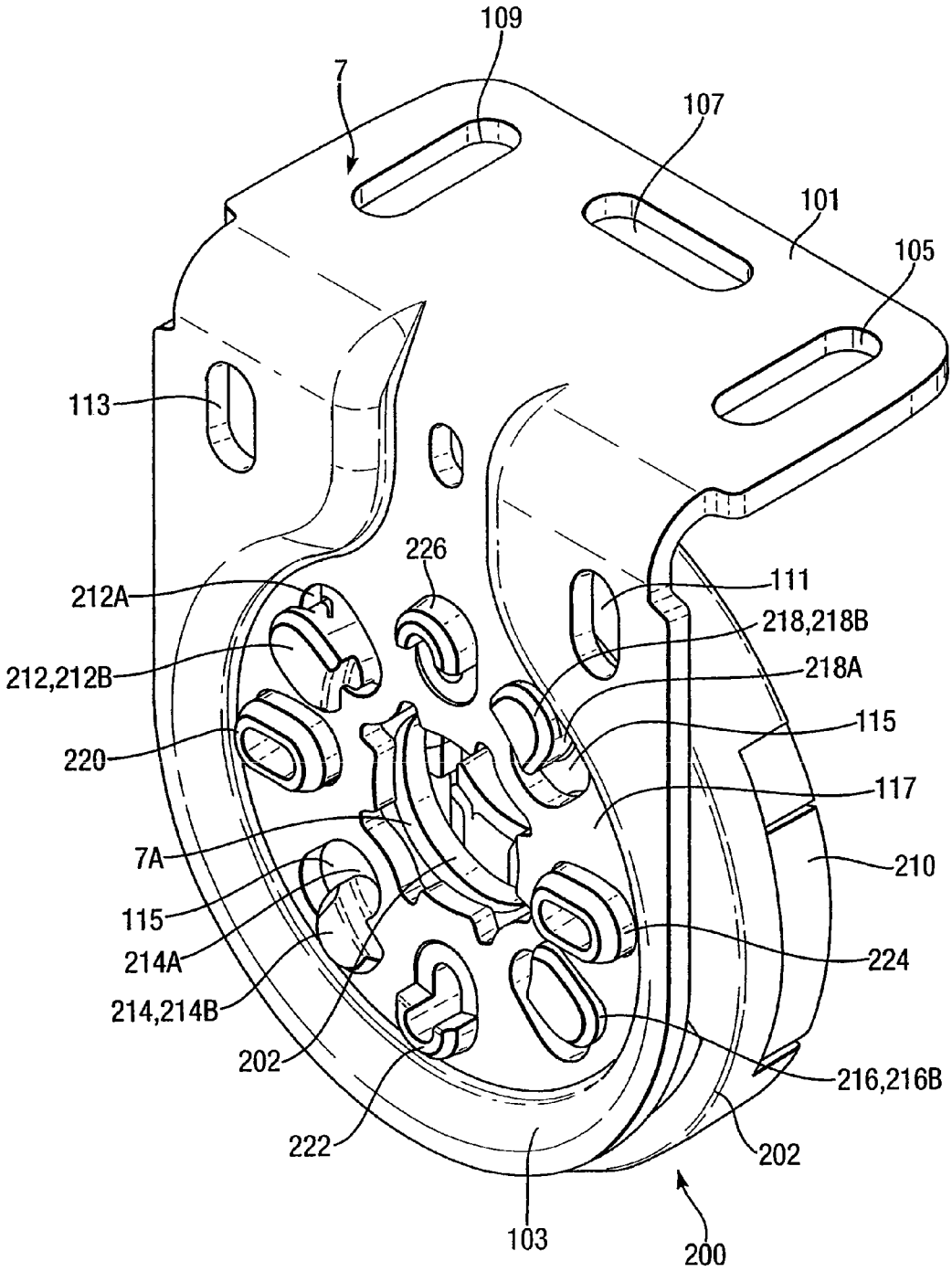
FIG. 6 is a perspective view from the rear of a bracket to which a leveler module is mounted.

FIG. 6 shows the rear of bracket 7 with the leveler module 200 mounted to thereto. The vertical flange 103 has a central depressed portion 117 in which are located the central aperture 7A with the mounting oblong holes 115 radially distributed about it. As can be seen a plurality of mounting means in the form of mounting hooks 212, 214, 216, 218 of the rotatably mounting tray 202 and a plurality of locator beads 220, 222, 224, 226 of the base member 204 alternatingly project through the mounting oblong holes 115. Each mounting hook 212,214,216, 218 includes a stem portion 212A, 214A, 216A, 218A and a grip portion 212B, 214B, 216B, 218A extending sideways the top of the stem portion. The bottom of the stem portions is connected to the rear of the mounting tray 202. The locator beads 220, 222, 224, 226 have approximately the circumferential shape of the oblong holes 115, and thus have a general oblong form. Attaching the leveler to the bracket takes two steps; positioning the leveler against the bracket such that the hooks and locator beads project through the mounting oblong holes 115 and subsequently rotating the mounting tray 202 clockwise to lock the leveler to the bracket by the hooks 212, 214, 216, 218 gripping over the rims of the oblong holes 115. During rotation of the tray 202, the locator beads check the rest of the leveler module against rotation. Thus the tray 202 rotates relative to the rest of the leveler module and the hooks lock about the rims of the openings 115. The spacing between the hooks and the rear of the mounting tray 202 is preferably equal or a little less than the thickness of the bracket material adjacent the oblong holes 115. The bracket surface will thus be clamped between the hooks and the rear of the tray once the hooks are rotated to their locked position. Additional locking means 258, 270, 272 are provided between on mounting tray and the rest of the leveler module which prevent the tray 202 from rotating on its own accord (e.g. caused by vibration or by operation of the blind or the like) in the opposite direction and thus disengaging the leveler from the bracket. These locking means are described in relation to FIG. 7.

The leveler module 200 can thus be easily, even single handedly, mounted to a bracket similar to a bayonet type quick release mechanisms. This is particularly convenient, for after-installment thereof. It also makes expensive bracket with integrally formed levelers obsolete. Since roller blinds with telescopic end plugs are also very easy to mount between two brackets, it is possible to postpone the decision to use a leveler until later. If, after mounting the roller blind it appears lopsided, the blind can be easily disengaged from the right bracket 7 and the leveler module 200 can be attached to the bracket and the blind remounted with the spigot of the telescopic end plug to the central opening 228 of the roller carrier 206 (which is visible in FIG. 5).

As shown in FIGS. 5 and 6 there are eight radially distributed openings 115 for the leveler to be mounted to. Thus the angular orientation of the leveler is selectable with increments of approximately 40 degrees. This is convenient since the leveler can always be installed such that its operator 208 is reachable.

Figure 7:
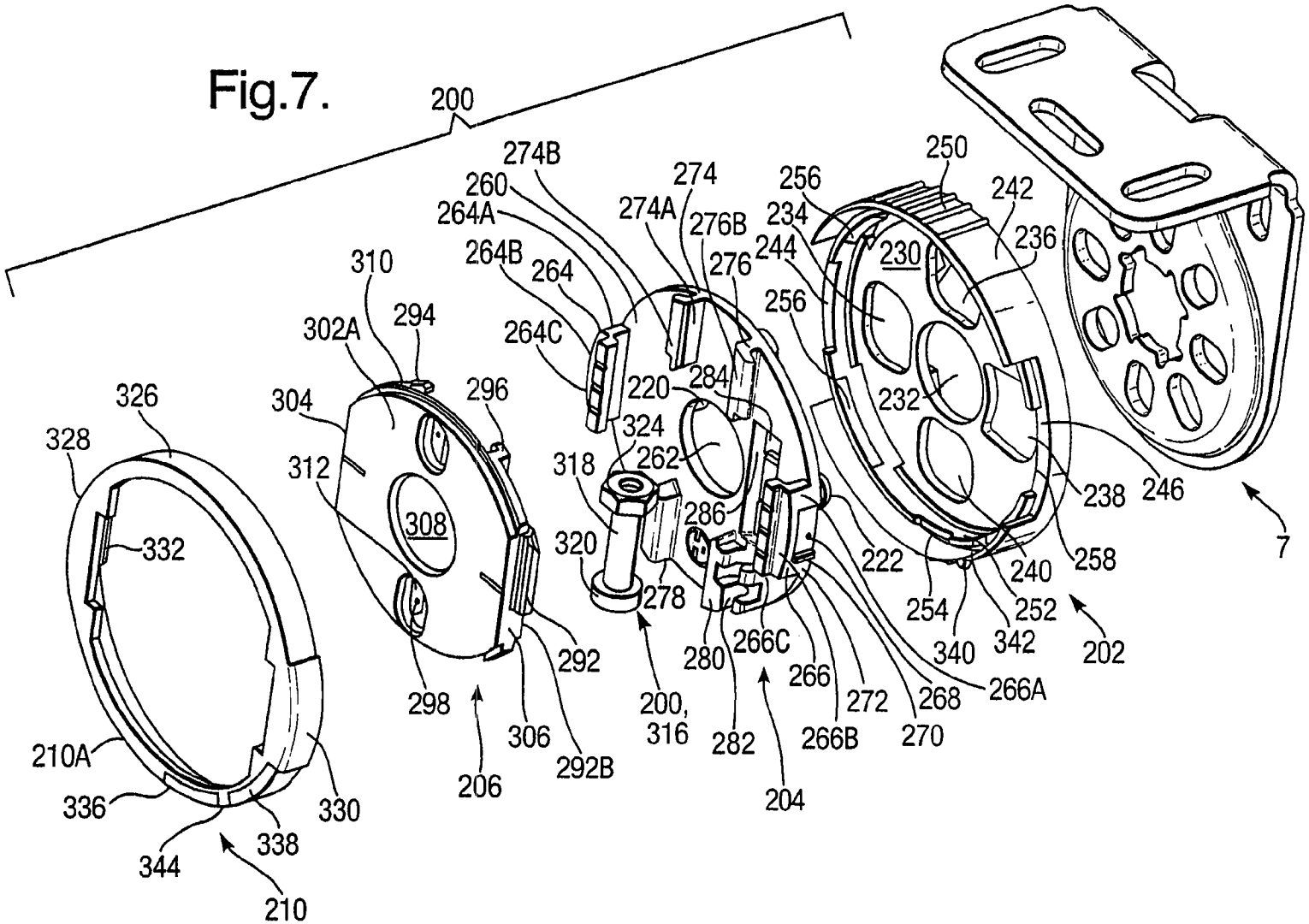
FIG. 7 is an exploded view of the leveler module.

The leveler module 200 is explained in more detail in relation to FIG. 7, which shows the leveler module in exploded view.

The mounting tray 202 is circular with a bottom surface 230 which has a central aperture 232, and four cutouts 234, 236, 238, 240 distributed radially about the central aperture. An axial border 242 projects frontally away from the bottom surface 230. The border 242 includes two opposite recesses 244, 246. Ribbing portions 250 on the outer circumferential surface 248 of the border 242 facilitate handling of the border and rotation of the mounting tray 202 while mounting the leveler module.

The mounting hooks 212, 214, 216, 218 (not visible in FIG. 7) project axially from the rear face 230A of the bottom surface 230 of the mounting tray 202.

An inner ring 252 co-axial to the border 242 forms a co-axial channel 254 for the cover ring 210. Extending radially from the top of inner ring 252 and towards the center of the mounting tray 202 are four snap flanges 256 which prevent the leveler base 204 from falling out from the tray 202. The flanges 256 reduce the inner diameter of the ring 252 of the tray and once the base 204 is in the tray, the flanges overlap portions of the base. Also extending radially form the inner ring 252, between bottom surface 230 and the top of the ring 252, is tray locking ridge 258 which cooperate with locking means 270,272 on the leveler base 204 to lock the leveler tray 202 against inadvertent rotation.

The leveler base 204, like the mounting tray 202, is circular with a bottom surface 260 and a central aperture 262. Projecting from the rear side 260A of the bottom surface 260 are the locator beads 220, 222, 224, 226, which are only partly visible in FIG. 7. When the leveler base 204 is snapped into the mounting tray 202, the locator beads project through the cutouts 234, 236, 238, 240 of the tray 202. The cutouts of the tray 202 are oversized in relation to the locator beads 220, 222, 224, 226 of the base. This difference in relative sizes facilitate rotation of the tray 202 relative to the base 204, which would be impossible if the cut-outs and beads matched in size and shape.

To the base 204 will be mounted an operator 208 and a roller carrier 206. The roller carrier 206 can slide relative to the base 204 by manipulating the operator 208. A pair of left and right generally Z-shaped flanges 264, 266 projecting from the base surface 260 facilitate the sliding co-operation between the base 204 and a first pair of complementary left and right wing-like side flanges 290, 292 on the roller carrier 206. The Z-shaped base flanges project from the edge of the base surface 260 and are located directly opposite each other. Each flange 264, 266 has a first leg 264A, 266A perpendicular to the base surface 260; an intermediate second leg 264B, 266B extending radially inward from the end of the first leg 264A, 266A parallel to the base surface 260, and a third leg 264C, 266C projecting perpendicular from the intermediate leg away from the base surface 260 and parallel off-set from to the first leg. Thus the Z-shaped flanges each comprise an inner surface of the second leg 264B, 266B parallel to the base surface 260 which will lie atop the a parallel surface 284B, 286B of the complementary wing flanges 290, 292 of the roller carrier 206.

The outer, circumferential surface of at least one of the first legs 264A,266A of the Z-flanges includes a radially inward recess 268 and within the recess 268 a locking bead 270 and locking gutter 272. The locking bead 270 projects from the recess 268 radially outward to the extent of the circumferential surface of the base 204, immediately adjacent the locking bead 270 is the locking gutter 272 which can accommodate the locking ridge 258 of the mounting tray 202. The gutter 272 fits between the bead 270 and the end of the recess, thus is bordered on both sides. Rotating the mounting tray 202, to lock the leveler to the bracket by the hooks 212, 214, 216, 218 gripping over the rims of the oblong holes 115, will cause the locking ridge 258 to jump the bead 270 and come to rest in the locking gutter 272.

Additionally a pair of hook-shaped pair of left and right flanges 274, 276 extend parallel to each other from the top of the base surface 260 towards the central base aperture 262 to co-operate with a first pair of complementary left and right hook-shaped flanges 294, 296 on the roller carrier. The base hook flanges 274, 276 each have a first hook leg 274A, 276A projecting perpendicular from the base surface 260; an second hook leg 274B, 276B extending radially outward from the end of the first hook leg 274A, 276A. Finally a pair of left and right guide legs 278, 280 is located opposite from the hook flanges 274,276 on the other side of the central base aperture 262. The guide legs 278, 280 project perpendicular from the base and guide a pair of complementary guide legs 298,300 on the roller carrier 206. Projecting to the right of the right guide leg 280 and fixed to the bottom surface 260 is a bearing 282 for rotatably holding the head 320 of the operator 208. The bearing 282 extends parallel right guide leg 280 in the general direction of the right hook shaped flange 276. In the extension thereof is a trough like slot 284 with angled side walls 286,288 for slidably holding the bolt 324 of the operator.

The roller carrier 206 is a semi-circular plate with a bottom surface 302 with an outer face 302A and an inner face 302B. Straight left and right sides 304,306 shape the carrier to a general oval form. The carrier is slidably mounted to the base 204 by the co-operating left and right wing-flanges 290, 292 cooperating with the left and right Z-shaped flanges 264, 266 of the base. These wing flanges 290,292 project perpendicular from the rear face 302B of the carrier 206 and radially outward. The carrier 206 further includes a central aperture 308 and a pair of opposite top and bottom oblong holes 310, 312. In use the rotatable cap 89 can project through the central aperture 308 while the outer surface of the radial collar 91 rests on the carrier's outer face 206A.

The rear face 206B of the carrier further includes the complementary left and right hook-shaped flanges 294, 296 which slidingly co-operate with the hook-shaped flanges 274, 276 of the base 204, and the complementary guide legs 298, 300 which slidingly cooperate with the guide legs 278, 280 of the base 204.

On the rear face 206B, juxtaposed to the right wing flange 292 and central aperture 308 is cradle 314 in which the nut 324 of the operator 208 is to be fixated. The nut 324 once placed in the cradle 314 can neither rotate nor slide relative to the cradle 314 of the carrier 206.

The operator 208 includes a bolt 316 having a threaded stem 318 and a head 320, at one end of the stem, with a countersunk hexagon socket 322 (not shown), and a hexagonal nut 324. The nut 324 has an internal thread (not shown) which co-operates with the stem 318 of the bolt 316. The head 320 of operator bolt 316 is rotatably fixed in a bearing 282 on the front of the base 204 and the nut 324 is unrotatably fixed to in cradle 312 of roller carrier 206. Thus the operator 208 is between the base 204 and the roller carrier 206 when these are assembled together. Since the nut 324 is fixed to the roller carrier 206 but slidable in trough 284 of the base 204, rotating the bolt 316 moves the nut 324 along the stem dragging the roller carrier 206 with it relative to the base 204.

As last item on FIG. 7 is shown the cover ring 210. This ring 210 has a front surface 210A and a axial circumferential rim 326. The ring includes left and right radial extending ears 328 and 330 from which left and right snap flanges 332, 334 radially projecting. In assembling the leveler, the ring is snapped over the base 204 after the base 204, roller carrier 206 and operator 208 are fit into the mounting tray 202. The ears 328, 330 are accommodated in the recesses 244, 246 of the mounting tray 202 while leaving space for the mounting tray 202 to be rotated relative to the ring 210. The snap flanges 332, 334 snap over the intermediate second legs 264B, 266B of the Z-shaped flanges of the base 204. When the mounting tray 202 is manipulated to lock the leveler 200 to the mounting bracket 7, the ring 210 remains stationary together with the other parts of the leveler. In FIGS. 5 and 7 indication marks "locked 336 and "unlocked 338 are placed on the ring's front surface 210A. A little radial projecting pimple 340 on the axial border 242 of the mounting tray 202, adjacent its front rim, is positionable by rotation of the mounting tray 202 in line with the locked 336 or unlocked 338 markings on the cover ring 210. An access opening 342 is present in the axial border 242 of the mounting tray 202 juxtaposed with the pimple 340. Likewise an ring opening 344 is present on the axial rim 326 of the cover ring 210 juxtaposed with 'locked' 336 marking. The relative locations of the openings 342, 344 and the associated indicator pimple 340 and locked marking 336 are chosen such that when the mounting tray is locked to the bracket, the pimple 340 and opening 342 align with a ring marking 'locked' 336 and ring opening 344. The aligned openings 338, 340 of the cover and the mounting tray allow the leveler 200 to be operated by a tool (not shown) to be inserted through the openings to act on the operator 208. When the mounting tray 202 is not locked to the bracket 7, the pimple 340 and its adjacent opening 342 are aligned with the marking 'unlocked' 338 on the cover ring such that the access openings 342, 344 are out off line, a tool cannot be inserted, and the leveler cannot be operated.

Compound Multi Roller Blind

Figure 8:
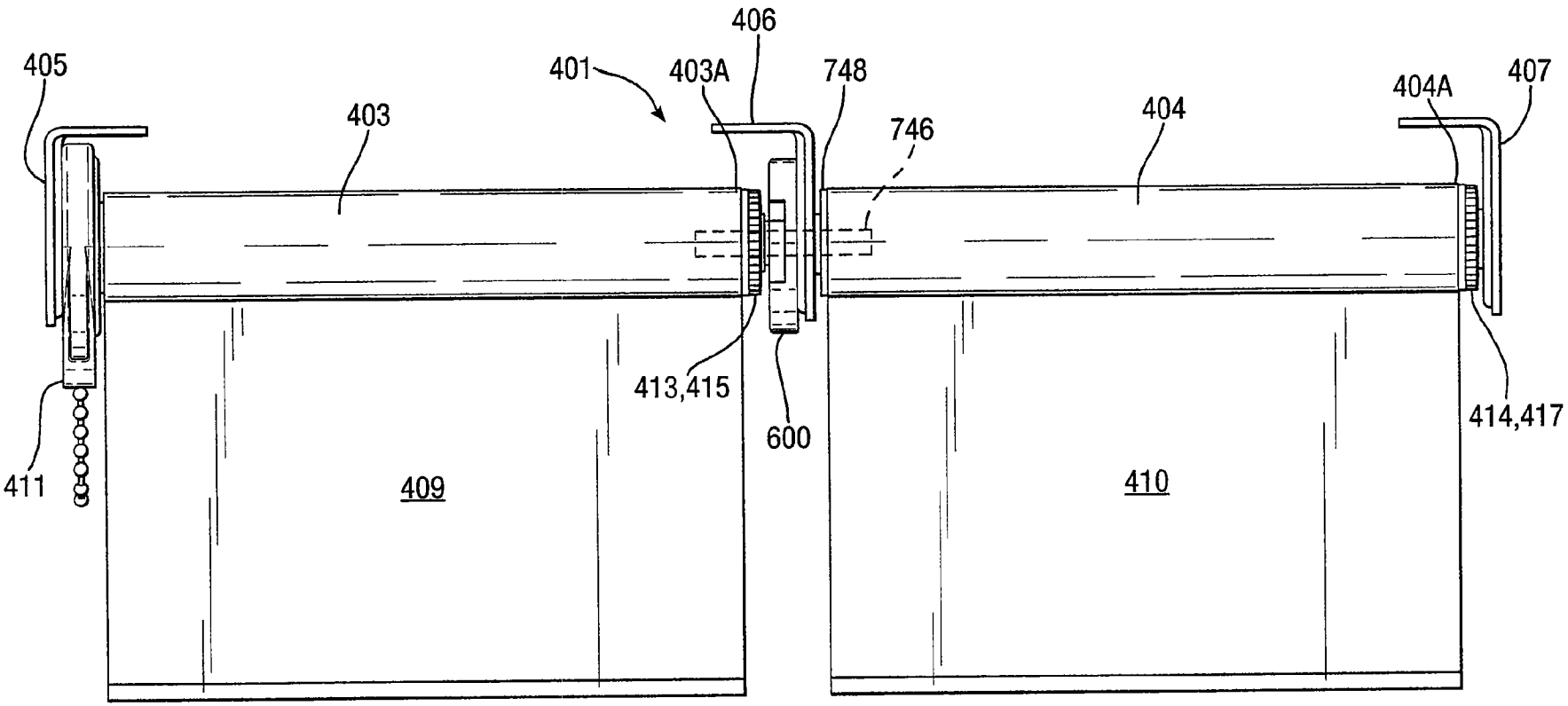
FIG. 8 is a general perspective view of a second embodiment of the roller mounting system of the invention in which a set of adjacent roller blinds are mounted having a common intermediate bearing bracket and each of which roller blinds includes an end plug of the invention and the two blinds share a leveler module.

FIG. 8 shows a further roller mounting system for a compound roller blind, by which system two rollers are mounted side by side, each mounted between a pair of spaced apart mounting brackets and the two blinds sharing an intermediate bracket. In describing this embodiment of the invention which is similar to that of FIG. 1 corresponding reference numerals (greater by 400) are used below for the same parts or corresponding parts.

In the blind 401 of FIG. 8 a pair of rollers 403 and 404 is mounted to a pair of left and right mounting brackets 405,407 and the rollers share a common intermediate bracket 406. The blind material 409, 410 is schematically indicated and can be wound and unwound from the roller by operating the bead chain operating mechanism 411. Each roller 403 and 404 is provided with a telescopic end plug 413, 414. Like in relation to the embodiment of FIG. 1, each telescopic end plug 413, 414 in the right end 403A, 404A of the roller 403, 404 facilitates mounting of the roller. These telescopic end plugs are identical to the one described in relation to FIGS. 1-3 and like reference numerals greater by 400 are used for like parts. For both rollers to be operated by the single operating mechanism 411 they are coupled together by a coupling shaft 746 indicated in dashed line. The couple shaft 746 has a cross-section for form fit to the spigot opening 483A of spigot 483 of the end plug 413 of the left roller 403. The left end 404B of the right roller 404 is provided with an end plug 748 which is provided with an opening similar to the spigot opening 483A. (not shown).

Additionally the composite blind 401 of FIG. 8 is provided with a leveler module 600 on the intermediate bracket 406.

The leveler module 600 is identical to the leveler 200 described in relation FIGS. 4-7 and like reference numerals greater by 400 are used for like parts. The intermediate bracket 406 is identical to bracket 7 which is described in relation to the previous figures.

The central apertures 406A, 630, 626, and 708 of respectively the intermediate bracket 407, the leveler mounting tray 602; the leveler base 604, and the leveler roller carrier 606 are large enough to accommodate the couple shaft 746 with room to spare for the leveler roller carrier to move up or down in order to level the two roller 403, 404 of the blind 401.

Mounting of the rollers of blind 401 can be done as follows: the left roller 403 is first mounted by depressing the end plug 413, positioning the roller 403 between the left bracket 405 and the intermediate bracket 406, and subsequently retracting the end plug 413 to its extended position, positioning the locking ring 415 adjacent the roller end 403A to lock the end plug against depression. Inserting the coupling shaft 746 from the right side of the bracket 406 into the spigot opening 483A. Mounting the right roller 404 by depressing the end plug 414, placing left end plug 748 over the projecting portion of the coupling shaft 746, positioning the roller 404 with respect to the right bracket 407, and subsequently retracting the end plug 414 to its extended position, positioning the locking ring 417 adjacent the roller end 404A to lock the end plug against depression.

Figure 9:
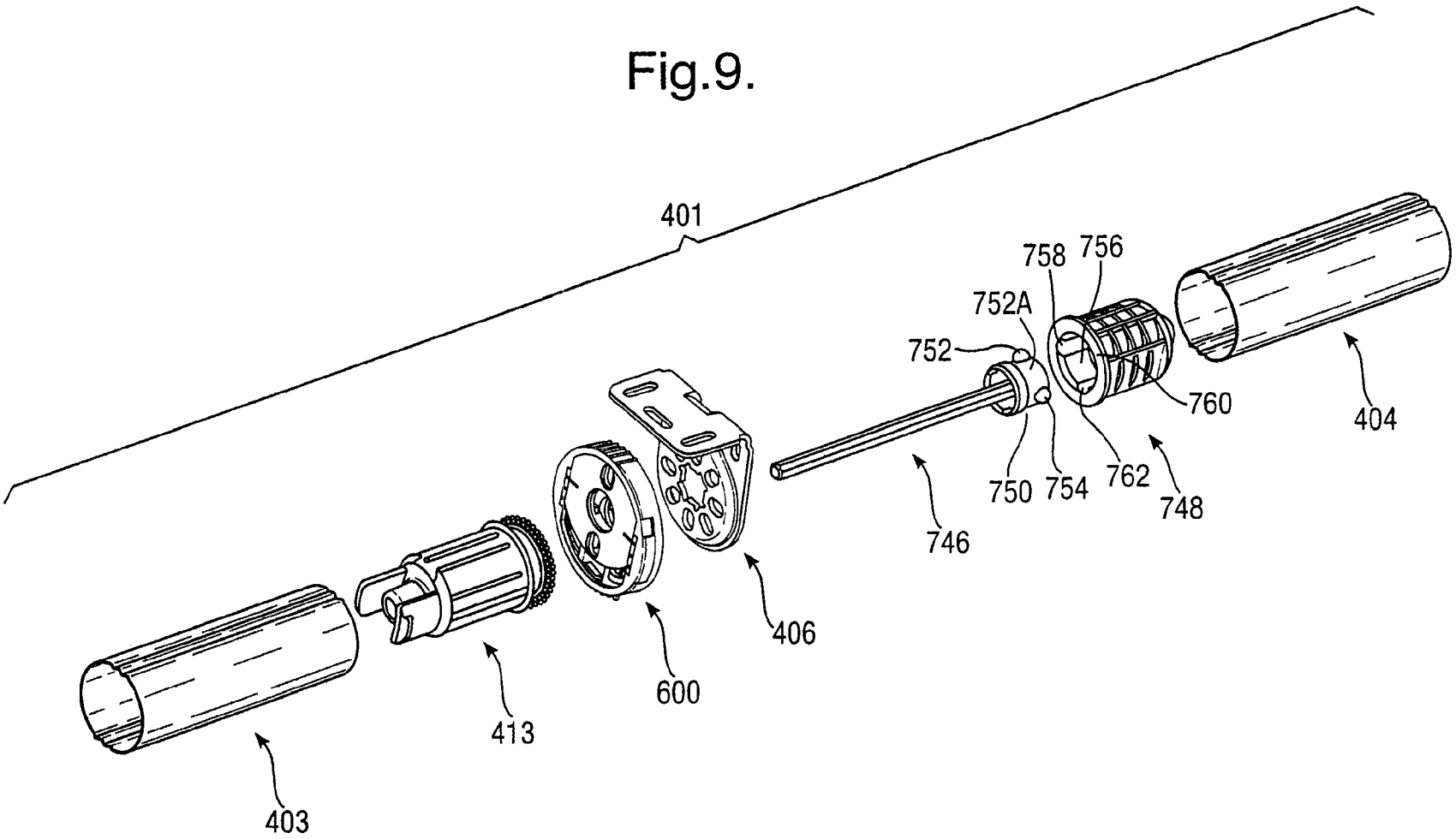
FIG. 9 is a partial exploded view of the second embodiment of the system of the invention

FIG. 9 is an exploded view of the centre parts of the compound blind of FIG. 8 with the intermediate bracket.

As can be seen in this exploded view the coupling shaft 746 is provided with a coupling head 750 from which project three of protrusions 752,754,756 creating a generally triangular cross-section of which the protrusions are the vertices and the connecting sides (752A, 754A, 756A) are curved. The end plug 748 has an internal recess 756 of identical cross-section and matingly receive coupling head 750. The protrusions 752, 754, 756 of the head 750 run into mating grooves 758, 760, 762 of the end plug 748. Thus a secure connection between coupling shaft 746 and the two roller 403 and 404 is made and the composite blind 401 can be operated by a single operating means 411.

FIGS. 10-12 and 13A-13C show the preferred operating mechanism 11, 411 and its co-operation with roller and bracket.

Figure 10:
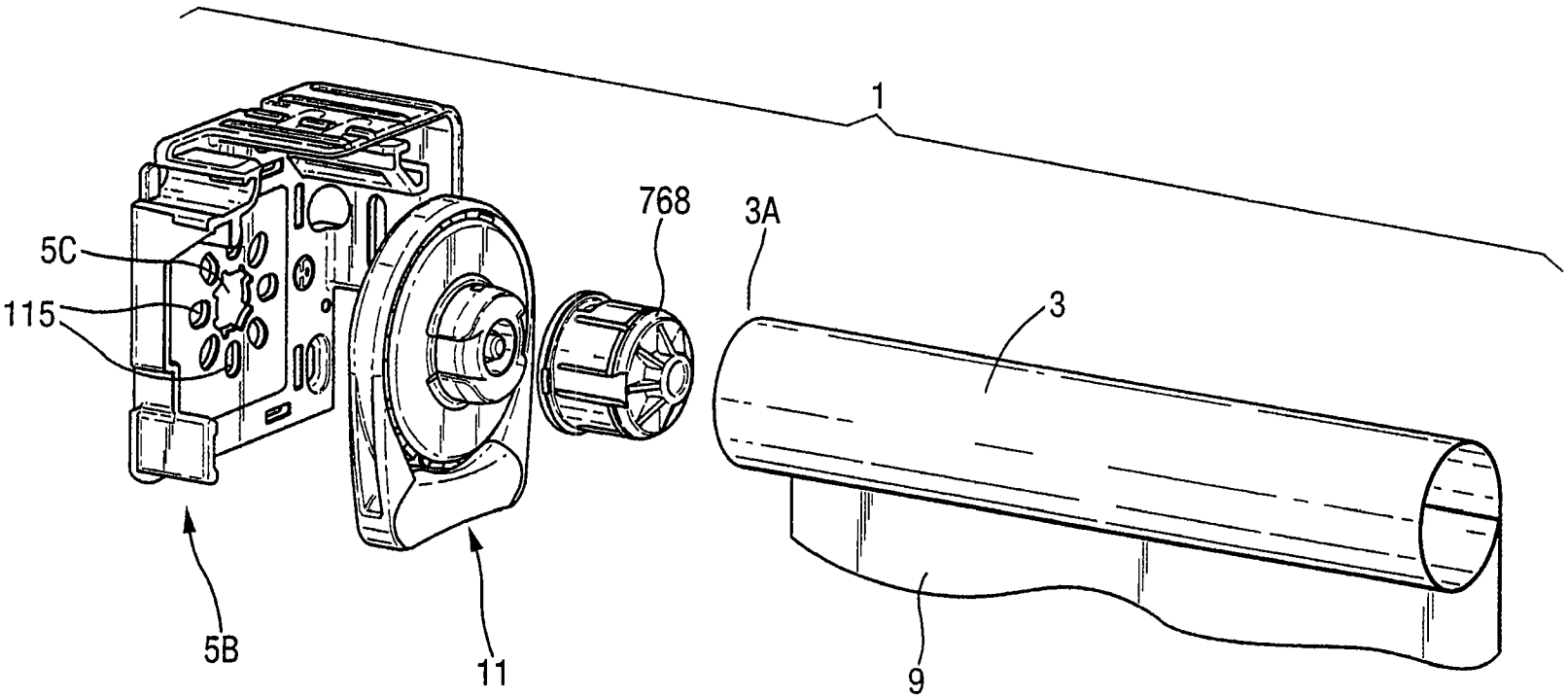
FIG. 10 is a partly exploded view of the roller system of the invention.

FIG. 10 shows the roller mounting system of FIG. 1, in exploded view from the side of the operating unit 11, included are an alternative mounting bracket 5B, the operating unit 11 and an adapter end plug 768 for left side 3A of the blind roller 3. The mounting bracket 5B is of the type describe in relation to FIGS. 3-7 in that it includes has a pattern of radially arranged slots or oblong holes 115 arranged around the central aperture 5C. The bracket 5B is further of a type suitable a so called cassette system, wherein the blind roller 3 is enclosed in a housing or head box (not shown, but conventional). The bracket 5B as shown in FIG. 10 is adapted to connect with such a housing or headbox and acts as an end wall therefore.

Figure 13C:
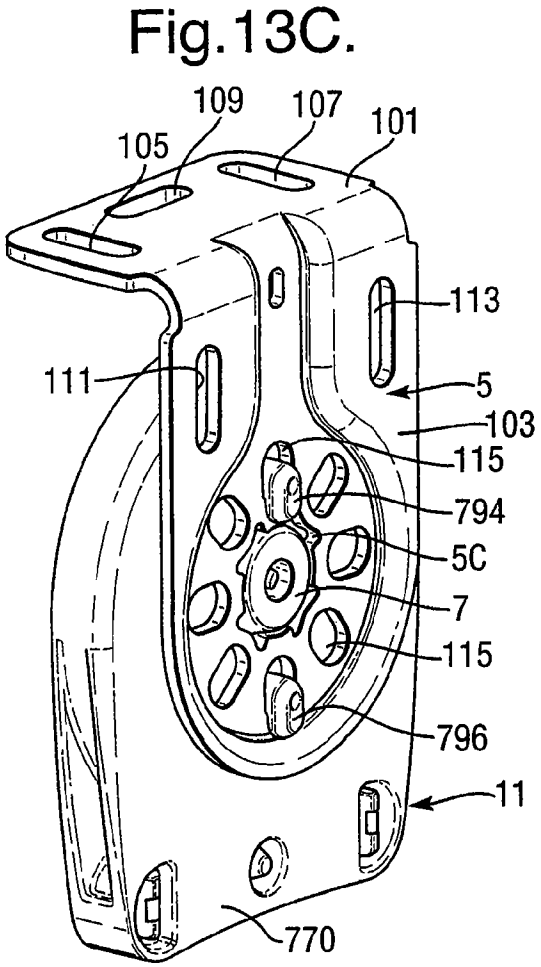
FIGS. 13A, 13B and 13C are the successive positions during attaching of an operating unit to a mounting bracket.
Figure 13B:
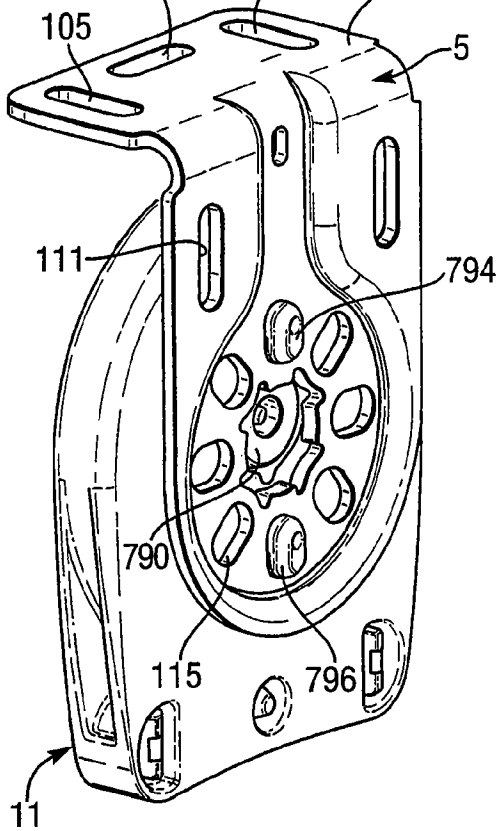
Figure 13A:
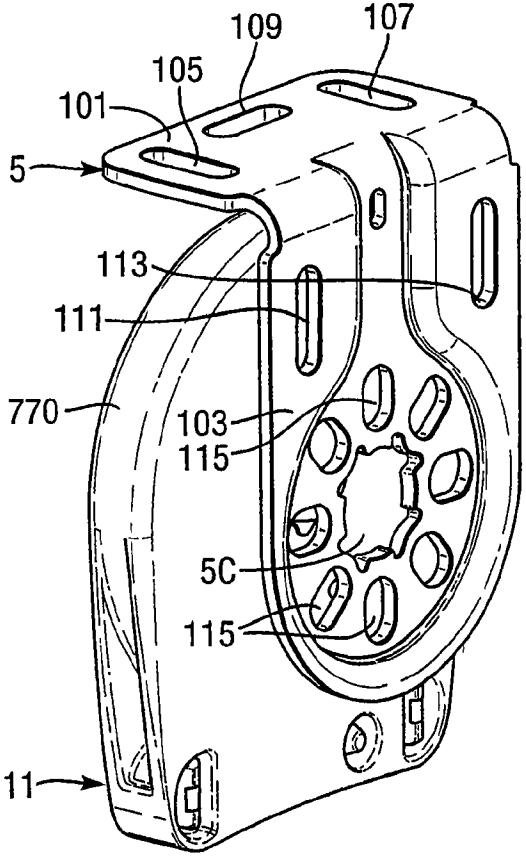

In FIGS. 13A-13C the bracket is shown as identical in shape to the intermediate bracket 406 of FIG. 10.

Figure 11:
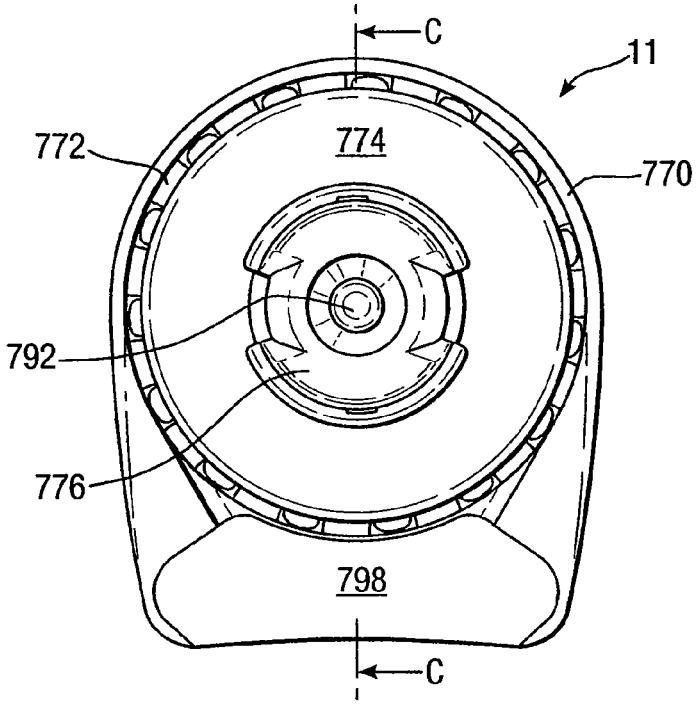
FIG. 11 is an elevation of the operating unit of FIG. 10 from its driving end.
Figure 12:
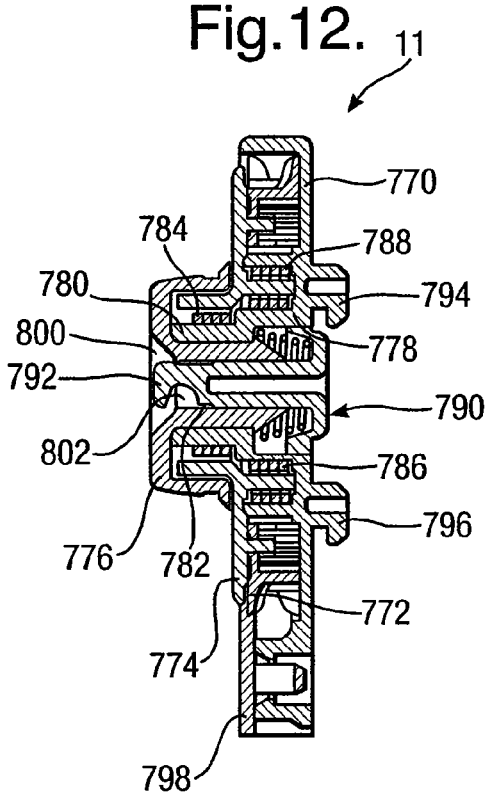
FIG. 12 is a cross section of the operating unit according to the line C-C in FIG. 11.

FIGS. 11 and 12 show the operating module 11 of the roller mount system. This includes a housing 770, a chain wheel 772, an engagement device 774. The chain wheel 772 is rotatably journalled on the housing 770 and may be rotated by a conventional ball chain (not shown).

Rotation of the chain wheel 772 will rotate the engagement device 774. The engagement device 774 has axially extending bosses for rotatably engaging a connector 776. The connector 776 has complementary axially extending bosses. The housing 770 has a central drum portion having a large diameter 778 and a small diameter section 780. The central drum portion further defines a central bore which rotatably receives an internal journal 782 on the connector 776. A total of three different wrap springs 784, 786, and 788 is provided for arresting the connector 776 against rotation when it is not being driven by the engagement device 774.

The connector 776 is provided with a central bore, which in use, is concentric with the bore in the housing 770. Slidably engaged in the central bore is latch plug 790 for the purpose of securing the housing 770 to a mounting bracket, as will be further described herein below. The latch plug 790 is also retained in the central bore 69 of the connector 25 by a stem with an enlarged head 792. As seen in FIG. 12, the housing 770 is also provided with hook members 794,796 for mounting to the bracket 5B. Each hook includes a stem portion 794A, 796A and a grip portion 794B, 796B extending downward from the top of the stem portion. The bottom of the stem portions is connected to the housing 770. Further there is provided a guarding bridge 798, that snap-fits onto the housing 770 as a separate element, to guide and retain the ball chain (not shown, but conventional), after it has been positioned in the housing 770. Also visible in FIG. 12 the central bore of the connector 776 opens into a recess 800 and that the stem of the latch plug 790 has a notch 802.

FIGS. 13A, 13B and 13C show the stages of mounting in operating unit 11 to a mounting bracket 5. The mounting bracket 5 is similar identical to the mounting bracket 5B shown in FIG. 1, but in an alternative basic form without provisions to co-operate with a housing or headbox. The mounting that will be described is similar for both forms of mounting bracket. The mounting bracket 3A has a generally horizontally extending first flange 101 and a depending vertically extending second flange 103. The first flange 101 has slots 105, 107, and 109 for receiving fasteners (not shown, but conventional) to mount the first flange against either under a horizontal building surface or to a vertical building surface adjacent a window opening. The second flange 103 has similar slots 111, 113 for alternative mounting to a vertical building surface in the proximity of a window opening.

For receiving the drive unit 11 the second flange 103 of the drive unit has a pattern of radially arranged slots 115 arranged around a central aperture 5C. The spacing of each pair of radially aligned slots 115 corresponds to the spacing between the hook member 794 and 796 on the housing 770 of the drive unit 11. The arrangement of four pairs of radially aligned slots 115 allows for a selection of angular positions into which the drive unit 11 can be mounted in respect of the bracket flanges. This is particular convenient for situations where the surface to which the bracket is mounted is slanted. The choice angular position for mounting the drive module 11 to the bracket can thus cancel out the slant angle.

FIG. 13A shows the drive unit 11 being presented to the bracket 5, but not yet engaged. FIG. 11B shows the first stage of engagement with the hook members 794 and 796 protruding through a pair of vertically aligned slots 115. Lowering the housing 770 to lock to the bracket by the hook's grip portions 794B, 796B gripping over the rims of the oblong holes 115. With this lowering movement accomplished as shown in FIG. 11C, the latch plug 790 will also have fully engaged the central aperture 5C by expansion of a spring 804 (visible in FIG. 12) biasing the latch plug in the direction of the bracket. This will effectively lock the drive unit 11 to the bracket 5 and prevent it from becoming accidentally dislocated. Removal is only possible by having the latch plug 790 retract in the central bore (as described hereinabove), sufficiently to unhook the hook members 794 and 796 from their respective slots 115.

The combination of the mounting hooks with the slots 115 of the brackets not only provides for an easy locking of the leveler or the operating module 11 to a bracket, it also conveniently leaves the central aperture of the bracket open. This is particularly useful for compound blinds in which a plurality of rollers is used and the rollers are operatively connected by a linking shaft (as shown in FIGS. 8 and 9). At the same time the free central aperture is of particular importance for allowing the latch plug 790 of the operating module 11 to be operational.

This invention is, of course, not limited to the exact configuration of the above-described embodiments which may be modified without departing from the scope of the invention or sacrificing all of its advantages. In this regard, the terms in the foregoing description and the following claims, such as "left", "right", "front", "rear", "vertical" and "horizontal" have been used only as relative terms to describe the relationships of the various elements of the roller mounting system of the invention.

For example, although the lugs 71A, 73A, 75A described in relation to FIG. 3 are shown to be on the outer surface of the tongues which cooperates with an indented portion 29A of the inner axial end 29 of the cylindrical body 21, instead they can also be on the inner surface and interact directly with the retainer flanges 45, 47, 49 of the cylindrical body 21.

Also, the spring 25 is an optional part of the end plug assembly. It is possible to use the end plug assembly of the invention without the spring. In that case the plunger 23 has to be maneuvered to its desired depressed or retracted position by hand, e.g. by rotating the locking ring 15 upon installment of the roller the spigot can be moved into association with the opening in the bracket.

Further, FIG. 6 shows four hooks and four locator beads but a different number of these are possible. It is presented that two or more hooks and at least one locator bead, provide for the best attachment of the leveler to the bracket.

Although a manual operating mechanism (11, 411) is shown, the blinds can also be motorized.

Although the leveler module 200 is described as including a cover ring 210, the leveler module will be equally easy mountable to the bracket and operational if the ring is not used. Even the safety feature of the unreachable operator 208 is not affected by not having a cover ring 210.

Although the pair of opposite top and bottom oblong holes 310, 312 on the roller carrier 206 of the leveler module 200 are not used in the described embodiments. They offer the possibility of mounting a roller, which instead of the described telescopic end plug 13 includes an alternative end plug with a pair of hook like mounting means, similar to the hooks 794, 796 as described in relation to the operating module 11. Such an alternative end plug can be mounted to leveler module 200 which in turn is mounted to a bracket. Such an alternative end plug can further in include a latch plug 790 like the one on the operating module.

The operating module 11 is describe including a latch plug 790, it is equally possible to use an operating module without such latch plug and have the module 11 be locked to bracket 5 by its hooks 794, 796 only.

Although the compound roller blind of FIG. 8 only shows a blind with two roller side by side, blinds with more than two rollers are also possible. The number of intermediate brackets will increase by one for each additional roller. It is likely that more leveler modules will than also be used.

The invention claimed is:

1. A telescopic end plug engageable within an end-opening of a roller, the end plug comprising:

a hollow body;

a plunger movably received within the hollow body and having a first portion and a second portion, the plunger being telescopically movable between a first end position in which the first portion of the plunger projects from the hollow body and the second portion remains within the hollow body, and a second end position in which at least part of the first portion is received within the hollow body;

a spring at least partially received within a portion of the plunger, for biasing the plunger towards the first end position; and a locking member threadingly engaged with the first portion of the plunger and selectively positionable on the first portion for locking the plunger against movement towards the second end position, wherein a portion of the locking member is positioned within the hollow body radially between the hollow body and the plunger when the locking member is positioned to lock the plunger against movement towards the second end position.

2. The telescopic end plug of claim 1, wherein the plunger further comprises a spigot extending from a first end; and at least two radially spaced tongues extending from a second end.

3. The telescopic end plug of claim 2, wherein a first end of the spring interacts with the spigot to bias the plunger towards the first end position.

4. The telescopic end plug of claim 3, wherein the hollow body further comprises a retainer base operably connected to a first end of the hollow body opposite of the first portion of the plunger and wherein a second end of the spring interacts with the retainer base.

5. The telescopic end plug of claim 4, wherein the spring extends between the retainer base and spigot and a length of the spring in an un-compressed position is longer than a distance between the retainer base and the spigot.

6. The telescopic end plug of claim 1, wherein the hollow body comprises at least one radially outwardly projecting rib configured to engage at least a portion of the roller.

7. The telescopic end plug of claim 1, wherein the plunger further comprises at least one axially-extending rib projecting radially outwardly from an outer surface of the plunger and configured to slidingly engage an inner surface of the hollow body.

8. A roller blind mounting system comprising:

at least one roller, at least one telescopic end plug according to claim 1, at least two brackets, wherein at least one of the brackets includes a central aperture, and wherein the first portion is mountable to the central aperture of the bracket.

9. The roller blind mounting system according to claim 8, wherein the telescopic end plug further comprises a rotatable end cap rotatably fixed to an end of the first portion, the end cap adapted to be received in the central aperture of the bracket such that the telescopic end plug and the roller engageable therewith are rotatably mountable to the bracket.

10. The telescopic end plug of claim 7, wherein the inner surface of the hollow body defines at least one axially-extending groove configured to receive the at least one axially-extending rib of the plunger.

11. A mounting system for an architectural covering comprising:

a pair of mounting brackets;

a roller operably connected to each of the pair of mounting brackets;

an end plug at least partially received within the roller and operably connected to one of the mounting brackets, the end plug including a sleeve having a sleeve cross section;

a plunger received within the sleeve and having a plunger cross section, the plunger including a center section; and at least two radially spaced tongues extending from a first end of the center section; and a spring at least partially received within the plunger;

wherein the sleeve cross section is larger than the plunger cross section;

when the plunger is in an extended position, a first portion of the plunger projects from the sleeve;

when the plunger is in a retracted position, at least a portion of the first portion of the plunger is received within the sleeve;

the spring biases the plunger away from the sleeve and towards the extended position; and a locking ring threadingly engaged with the plunger and configured to selectively prevent the plunger from moving towards the retracted position, wherein a portion of the locking ring is positioned within the sleeve radially between the sleeve and the plunger when the locking ring prevents the plunger from moving towards the retracted position.

12. The mounting system of claim 11, wherein the at least two radially spaced tongues comprises three radially spaced tongues.

13. The mounting system of claim 12, wherein each of the three radially spaced tongues include a lug operably connected to a first end of each of the three radially spaced tongues, wherein the lug cooperates with the sleeve to substantially prevent the plunger from disengaging with the sleeve.

14. The mounting system of claim 11, wherein the sleeve comprises at least one radially outwardly projecting rib configured to engage at least a portion of an inner surface of the roller.

15. The mounting system of claim 11, wherein the plunger further comprises at least one axially-extending rib projecting radially outwardly from an outer surface of the center section and configured to slidingly engage an inner surface of the sleeve.

16. The mounting system of claim 11, wherein the plunger further comprises an outer part extending from a second end of the center section, the outer part having a threaded outer surface; and the locking ring is threadingly engaged with the outer part of the plunger.

17. An end plug for operably connecting a roller for an architectural covering to a bracket comprising:

a hollow body;

a movable member at least partially received within the hollow body including a body portion; and at least one tongue extending from a first end of the body portion;

a spring at least partially received within the movable member; and a locking member operably connected to the movable member and configured to selectively prevent the movable member from transitioning between an extended position and a retracted position; wherein in the extended position a first portion of the movable member projects from the hollow body and in the retracted position at least a portion of the first portion of the movable member is received within the hollow body; and the spring biases the movable member away from the hollow member and towards the extended position, wherein a portion of the locking member is positioned within the hollow body radially between the hollow body and the movable member when the locking member prevents the movable member from transitioning between the extended position and the retracted position.

18. The end plug of claim 17, wherein the at least one tongue includes a lug operably connected to a first end of the at least one tongue opposite of the body portion, the lug configured to prevent the movable member from extending completely out of the hollow body.

19. The end plug of claim 17, wherein the locking member is threadingly received on the first portion of the movable member.

20. The mounting system of claim 17, wherein the hollow body includes an inner surface having a plurality of axially-extending, radially-spaced grooves; and the body portion includes an outer surface and a plurality of axially-extending ribs protruding radially outwardly from the outer surface and configured to slidingly cooperate with the plurality of grooves.

* * * * *